US005896832A

United States Patent [19]

Aoki et al.

[11] Patent Number: 5,896,832

[45] Date of Patent: Apr. 27, 1999

[54] VISCOUS FLUID HEAT GENERATOR

[75] Inventors: Shinji Aoki, Kariya; Toshio Morikawa, Toyota; Hajime Ito, Kariya, all of Japan

[73] Assignee: Denso Corporation, Kariya, Japan

[21] Appl. No.: 08/967,547

[22] Filed: Nov. 10, 1997

[30] Foreign Application Priority Data

Nov. 20, 1996 [JP] Japan ..... 8-309182

[51] Int. Cl.[6] ..... F02N 17/02

[52] U.S. Cl. ..... 122/26; 126/247; 123/142.5 R

[58] Field of Search ..... 123/142.5 R; 126/247; 122/26; 237/12.3 R, 12.3 B

[56] References Cited

U.S. PATENT DOCUMENTS

| | | | |
|---|---|---|---|
| 4,387,701 | 6/1983 | Gibbons . | |
| 4,974,778 | 12/1990 | Bertling | 237/12.3 B |
| 4,993,377 | 2/1991 | Itakura | 123/142.5 R |
| 5,743,467 | 4/1998 | Ban et al. | 237/12.3 R |
| 5,752,499 | 5/1998 | Mori et al. | 126/247 |
| 5,791,558 | 8/1998 | Hoshino et al. | 237/12.3 B |

FOREIGN PATENT DOCUMENTS

| | | |
|---|---|---|
| 0 361 053 A2 | 9/1989 | European Pat. Off. . |
| 0 773 122 A2 | 5/1997 | European Pat. Off. . |
| 0 800 942 A1 | 10/1997 | European Pat. Off. . |
| A-3-57877 | 3/1991 | Japan . |
| U-03-98107 | 10/1991 | Japan . |

OTHER PUBLICATIONS

U.S. application No. 08/835,311, Ban, filed Apr. 7, 1997.
U.S. application No. 08/862,866, Aoki et al., filed May 23, 1997.
U.S. application No. 08/886,667, Aoki et al., filed Jul. 1, 1997.
U.S. application No. 08/892,411, Ito et al., filed Jul. 14, 1997.
U.S. application No. 08/898,536, Aoki et al., filed Jul. 22, 1996.
U.S. application No. 08/901,370, Ito, filed Jul. 28, 1997.
U.S. application No. 08/915,155, Aoki et al., filed Aug. 20, 1997.
U.S. application No. 08/933,295, Inoue et al., filed Sep. 18, 1997.
U.S. application No. 08/935,179, Aoki et al., filed Sep. 22, 1997.
U.S. application No. 08/937,050, Aoki et al., filed Sep. 24, 1997.
U.S. application No. 08/936,257, Aoki et al., filed Sep. 24, 1997.
U.S. application No. 08/937,049, Aoki et al., Sep. 24, 1997.

*Primary Examiner*—Henry C. Yuen
*Assistant Examiner*—Hai Huynh
*Attorney, Agent, or Firm*—Harness, Dickey & Pierce, PLC

[57] ABSTRACT

A viscous fluid heat generator includes: a shear chamber in which viscous fluid is contained and heat is generated by shearing the viscous fluid with a rotor rotating therein; and a space receiving viscous fluid drained from the shear chamber. The heat generator is rotated always as far as an engine rotates because it is driven by the engine without a clutch. The viscous fluid in the shear chamber is drained into the receiving space disposed underneath the shear chamber when the rotor halts or the heat generator is not in operation. The drained viscous fluid is pushed up again into the shear chamber when the rotor is re-started or the heat generator becomes in operation again. The heat generator is re-started easily with a very small starting torque because there is almost no viscous fluid left in the shear chamber and accordingly power to shear the viscous fluid with the rotor is not required. Only a minimal power is consumed by the heat generator when heat is not required to be generated even though the rotor is continuously rotated because the viscous fluid in the shear chamber is drained in this situation.

8 Claims, 4 Drawing Sheets

VISCOUS FLUID HEAT GENERATOR

CROSS-REFERENCE TO RELATED APPLICATION

This application is based upon and claims benefit of priority of Japanese Patent Applications No. Hei-8-309182 filed on Nov. 20, 1996, the content of which is incorporated herein by reference.

BACKGROUND OF THE INVENTION

1. Field of the Invention

The present invention relates to a viscous fluid heat generator which heats a heat medium such as an engine coolant with heat generated by shearing viscous fluid. The viscous fluid heat generator is used, for example, as a heat source for a heater mounted on an automotive vehicle.

2. Description of Related Art

A heat generator which generates heat by shearing viscous fluid contained in a small space is disclosed, for example, in JP-A-3-57877. The heat generated is used for heating an engine coolant. A rotor of the heat generator disclosed therein is rotated by an engine through an electromagnetic clutch which connects or disconnects rotating force of the engine to the rotor. That is, rotation of the rotor is shut off when heat generation is not required. Because the electromagnetic clutch is used, the heat generator disclosed therein becomes large in size and heavy in weight, resulting in a high cost. Therefore, it is desirable to eliminate the clutch. If the clutch is eliminated and the rotor rotates all the time, the engine power to rotate the rotor is always consumed even when it is not required to generate heat. Especially, a large torque for starting the heat generator is necessary.

SUMMARY OF THE INVENTION

The present invention has been made in view of the above-mentioned problem, and an object of the present invention is to provide a viscous fluid heat generator, having no clutch for connecting or disconnecting an engine thereto, which does not consume unnecessary power and does not require a large starting torque.

The heat generator according to the present invention includes a shear chamber in which a rotor driven by an engine and viscous fluid are contained and heat is generated by shearing the viscous fluid with the rotor rotating therein, and a space for receiving the viscous fluid drained from the shear chamber when the heat generator is not in operation. The volume of the viscous fluid receiving chamber is made so that it can be changed. When the rotor discontinues its rotation, the viscous fluid contained in the shear chamber drops down to the receiving space by gravity because the volume of the receiving space is increased in this situation. In other words, the viscous fluid in the shear chamber is drained when the rotor stops. Therefore, when the rotor is re-started next time, the starting torque required will be very small because there is almost no viscous fluid left in the shear chamber. When the rotor is re-started after the viscous fluid in the shear chamber has been drained, the viscous fluid in the receiving chamber is again pushed up to the shear chamber by decreasing the volume of the receiving chamber. That is, once the rotor is rotated, the viscous fluid is supplied into the shear chamber and heat is generated therein by shearing the viscous fluid.

The volume of the receiving space is changed by various ways. It may be changed by slidably driving a piston in the receiving chamber. The piston may be driven by an actuator having a material which is responsive to temperature, such as thermo-wax. When the temperature of the heat generator falls after the operation of the heat generator has been discontinued, the thermo-wax retracts and thereby drives the piston so that the volume of the receiving chamber is increased. On the other hand, when the temperature rises due to the operation of the heat generator, the thermo-wax expands and thereby drives the piston in a direction to decrease the volume of the receiving chamber. The piston may be driven by an electromagnetic actuator which is energized or de-energized according to the operation of the heat generator. In this case, when a halt of the rotor is detected, the volume of the receiving chamber is increased by the electromagnetic actuator, thereby draining the viscous fluid in the shear chamber into the receiving space.

In case the heat generation in the heat generator is not required while the rotor continues to rotate, the heat generator according to the present invention consumes a minimal power because the viscous fluid supply to the shear chamber is shut off and the viscous fluid in the shear chamber is drained into the receiving space.

Grooves for leading the viscous fluid in the shear chamber from its inside portion to its outer periphery may be made on the surface of the rotor to make a viscous fluid flow in the shear chamber smooth. Also, a return passage for leading the viscous fluid from the outer periphery of the shear chamber to a reservoir reserving the viscous fluid therein may be made on a rotor case forming the shear chamber to help the fluid smoothly circulate in the heat generator.

In summary, the heat generator according to the present invention can be re-started with a small starting torque and consumes only a minimal power when no heat generation is required, because the viscous fluid in the shear chamber is drained when the rotor is not rotating or when the heat generator is not in operation while the rotor continues to rotate.

Other objects and features of the present invention will become more readily apparent from a better understanding of the preferred embodiments described below with reference to the following drawings.

DETAILED DESCRIPTION OF THE PREFERRED EMBODIMENTS

Figure 1:
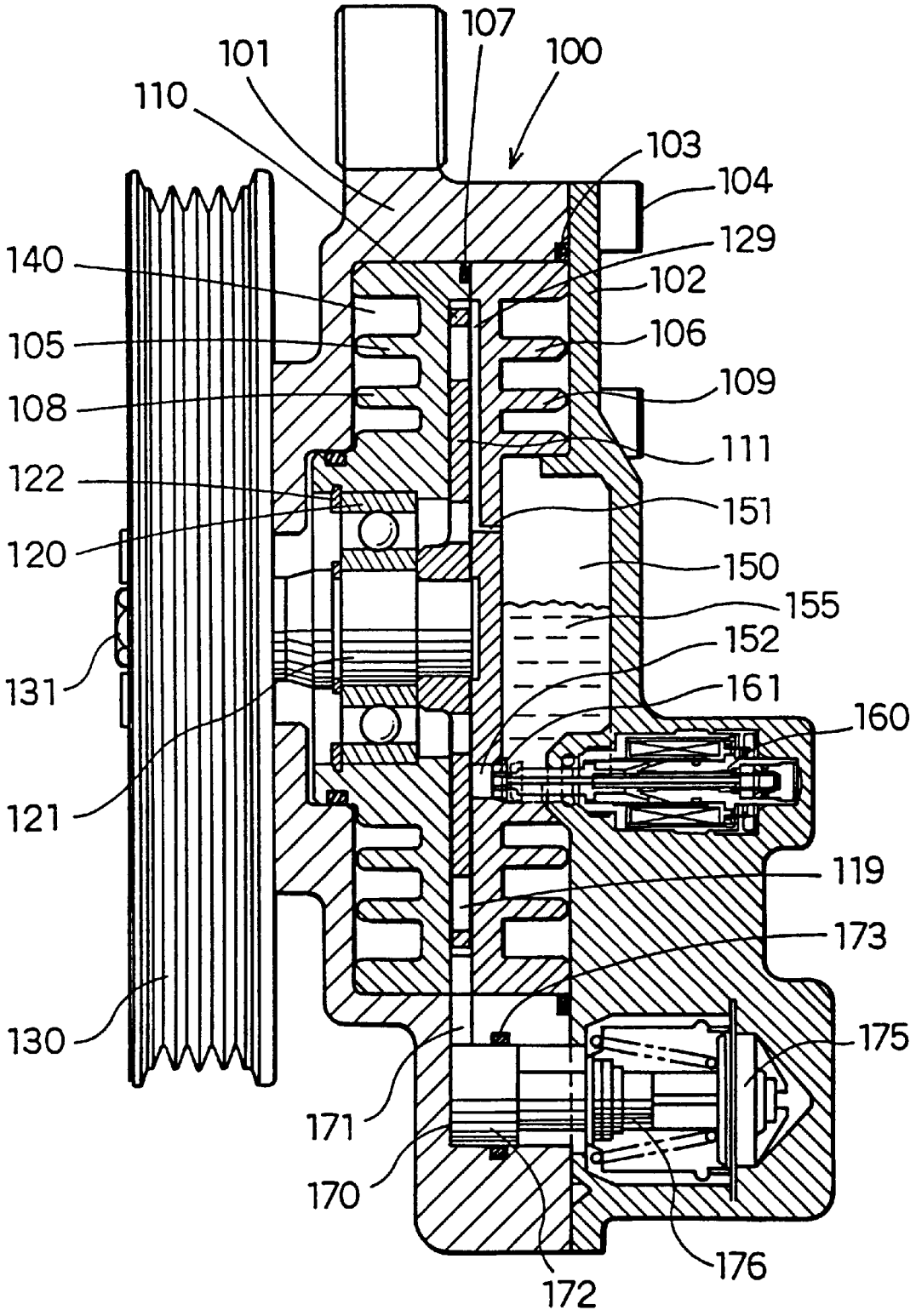
FIG. 1 is a cross-sectional view, taken along a line I—I of FIG. 2, showing a viscous fluid heat generator as a first embodiment according to the present invention.
Figure 2:
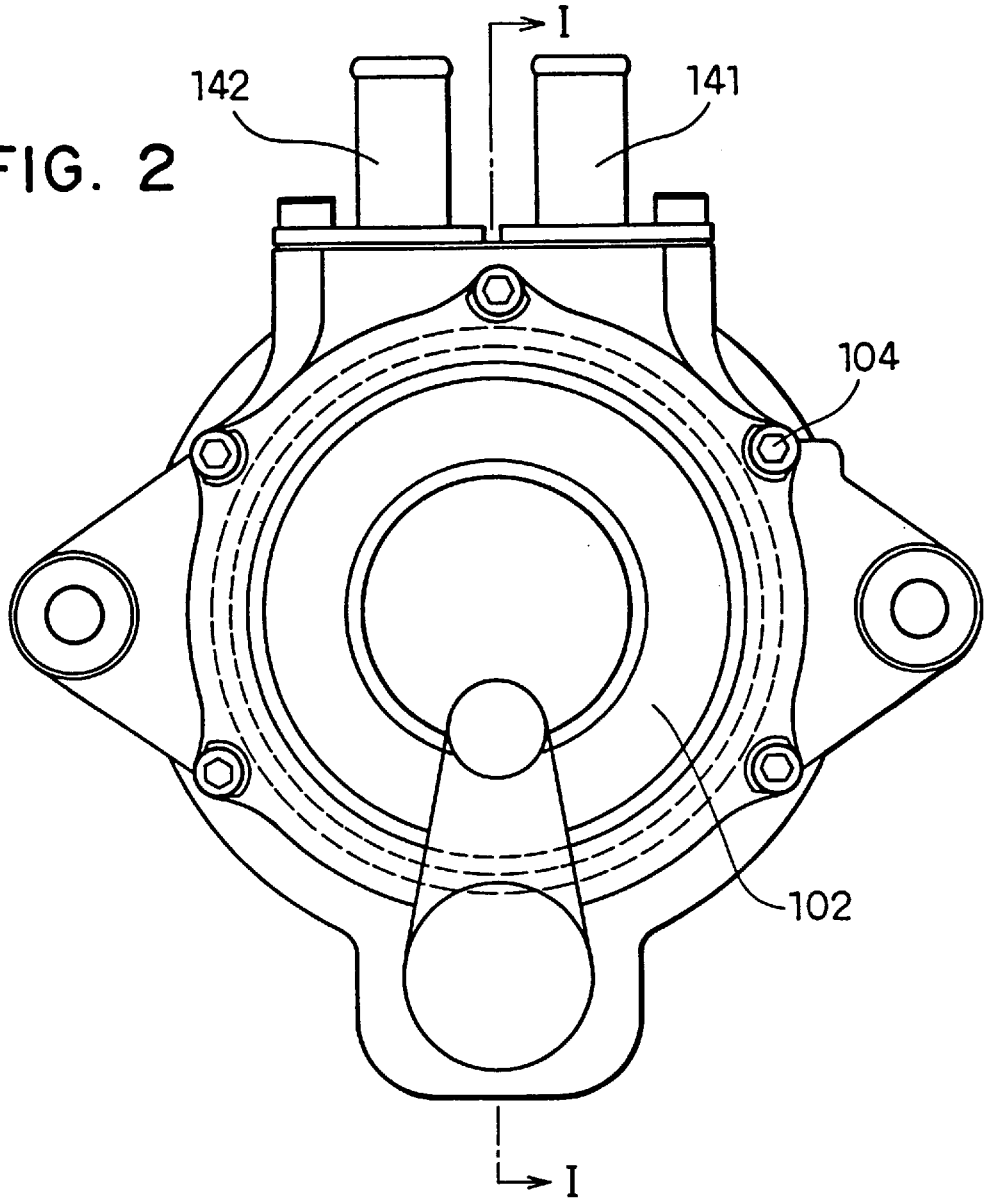
FIG. 2 is a side view showing the first embodiment shown in FIG. 1.
Figure 3:
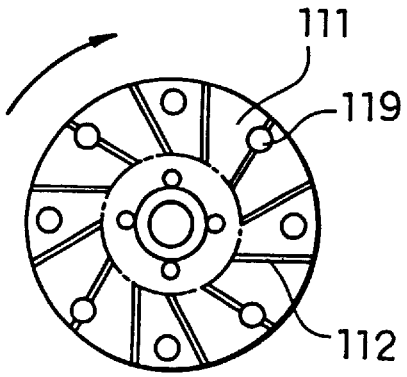
FIG. 3 is a plan view showing a rotor used in the viscous fluid generator shown in FIG. 1.

Referring to FIGS. 1 through 3, a first embodiment according to the present invention will be described. As shown in FIG. 1, the viscous fluid heat generator 100 has a pair of housing, a front housing 101 and a rear housing 102, made of aluminum alloy. A rear side (left side of FIG. 1) of the front housing 101 is closed by the rear housing 102 which is fixed to the front housing 101 by bolts 104. An O-ring 103 is disposed between the front and rear housings to tightly close an inner space defined by both housings. A front fin plate 105 and a rear fin plate 106 are disposed in the space enclosed by both housings with an O-ring 107 interposed liquid-tightly therebetween, constituting a rotor case. A narrow space between both fin plates 105 and 106 constitutes a shear chamber 110 in which a rotor 111 is disposed. A plan view of the rotor 111 is shown in FIG. 3. The rotor 111 is made of steel and has a plurality of grooves 112 formed on both surfaces thereof by machining. The rotor 111 rotates clockwise as shown by an arrow.

As shown in FIG. 1, a bearing 120 rotatably supporting a shaft 121 is press-fitted in the center of the front fin plate 105 and fixed by a round clip 122 therein. The shaft 121 is made of carbon steel. To its rear end the rotor 111 is connected and to its front end a pulley 130 is fixed by a bolt 131. The pulley 130 having several grooves on its outer periphery is made of a steel plate by presswork. The pulley 130 is driven by an engine through a V-belt. The rotor 111 disposed in the shear chamber 110 is rotated by the engine all the time when the engine is in operation.

The rotor 111 is disposed in the shear chamber 110 so that narrow gaps of about 0.25 mm thick are formed between the rotor 111 and the fin plates at both sides of the rotor 111. Through-holes 119 which serve to enhance shearing force (explained later) are formed on the rotor 111. The front and rear fin plates 105 and 106 have respective fins 108 and 109 formed thereon. The height of the fins 108 and 109 is about 10 mm, and the interval space between neighboring fins is about 3 ~4 mm. The intervals between the fins constitute passages 140 for engine coolant.

As shown in FIG. 2, an inlet pipe 141 and an outlet pipe 142 for the engine coolant are disposed on the front housing 101 at an equal horizontal level. The inlet and outlet pipes 141 and 142 are respectively connected to the engine coolant passages 140. The coolant entered into the inlet pipe 141 flows through the coolant passages 140 encircling the shaft 121 and flows out from the outlet pipe 142. The coolant is pressurized by a water pump (not shown in the drawings) and circulated through the viscous fluid heat generator 100. An amount of the coolant circulated through the heat generator is controlled by the water pump and a control valve (not shown in the drawings). The heat generator 100 itself does not pressurize the coolant nor controls the amount thereof.

A reservoir 150 for containing viscous fluid 155 therein is formed between the rear fin plate 106 and the rear housing 102. The reservoir 150 is completely separated from the coolant passages 140 by press-fitting the rear fin plate 106 into the rear housing 102. An inlet hole 152 to lead the viscous fluid into the shear chamber 110 from the reservoir 150 is formed at a lower portion of the reservoir 150, and an outlet hole 151 to lead the viscous fluid into the reservoir 150 from the shear chamber 110 is formed at an upper portion of the reservoir 150. The viscous fluid 155 in the reservoir 150 is sucked into the shear chamber 110 through the inlet hole 152 by centrifugal force generated by rotation of the rotor 111, and the viscous fluid pressurized in the shear chamber 110 by the centrifugal force is discharged to the reservoir 150 through the outlet hole 151. Therefore, the diameter of the inlet hole 152 is made larger than that of the outlet hole 151. In this particular embodiment, the diameter of the inlet hole 152 is about 13 mm, and that of the outlet hole 151 is about 1 mm. An electromagnetic valve 160 for driving a valve 161 which opens or closes the inlet hole 152 is disposed in the rear housing 102. The inlet hole 152 is opened when the electromagnetic valve 160 is energized, and closed by a return spring when the electromagnetic valve 160 is de-energized.

The viscous fluid used in the heat generator must have a high viscosity, and the viscosity must not be decreased at a high temperature. In this particular embodiment, silicone oil is used which has a viscosity of 12,000~30,000 cst (centistokes) and is heat-resistant up to about 200° C.

A space 170 for containing the viscous fluid dripped down from the shear chamber 110 is provided at a lower part of the front housing 101. The space 170 are connected with the shear chamber 110 through a dripping passage 171. A piston 172 is disposed in the space 170 so that the volume of the space 170 is changed by axially sliding the piston 172. An O-ring 173 is disposed to encircle the piston 172 in the bore of the space 170 to keep the space 170 liquid-tight. The piston 172 is connected to an actuator 175 disposed at a bottom portion of the rear housing 102. The actuator 175 drives the piston 172 back and forth in the axial direction in the space 170. The actuator includes a cylinder 176 which contains thermo-wax therein. At a predetermined temperature, for example, 70° C., the thermo-wax expands abruptly and pushes the piston 172 leftward, thereby decreasing the volume of the space 170.

The operation of the viscous fluid heat generator 100 described above will be explained. The heat generator 100 is mounted on an engine and the pulley 130 is driven by the engine through a V-belt. The rotor 111 disposed in the shear chamber 110 is rotated therein and shears the viscous fluid contained in the shear chamber 110, thereby generation heat therein. An amount of heat generated depends on the rotational speed of the rotor 111. It is known that the amount of heat generated by shearing the viscous fluid is, theoretically, proportional to the second power of the rotational speed. However, in a practical device the amount of heat generated is not proportional to the second power but roughly proportional to the rotational speed, because the viscosity of the fluid decreases as temperature rises. A diameter of the pulley 130 in this embodiment is selected so that the pulley 130 rotates at a speed a little higher than the engine. When the rotor 111 rotates, the viscous fluid 155 in the reservoir 150 is sucked into the shear chamber 110 by a centrifugal force generated by the rotor 111 through the inlet hole 152. The viscous fluid in the shear chamber 110 moves radially from the inside to the outside of the shear chamber 110, and returns to the reservoir 150 through a return passage 129 formed on the rear fin plate 102 and the outlet hole 151. Thus, the viscous fluid is circulated between the reservoir 150 and the shear chamber 110.

The viscous fluid heat generator is used mainly for the purpose of compensating shortage of heating ability of a heating system in cold winter time, and especially for obtaining rapid heating at an engine start-up. Therefore, once the engine coolant has sufficiently warmed up, there is no need to generate additional heat by the heat generator even in cold winter time. In a warm season, of course, the additional heat generation is not needed because the heating system itself is not operated. Since a clutch for connecting or disconnecting the heat generator 100 to the engine is eliminated and the generator is rotated as long as the engine is in operation, it is necessary to lessen the engine load when the additional heat generation is not required. For this purpose the first embodiment according to the present invention operates in a manner described below.

When heat generation in the heat generator 100 is not required, the inlet hole 152 is closed by de-energizing the electromagnetic valve 160, thereby shutting off the viscous fluid supply to the shear chamber 110. The viscous fluid in the shear chamber 110 is pushed out radially by the centrifugal force of the rotor 111 and returned to the reservoir 150 through the return passage 129 and the outlet hole 151. Therefore, almost all viscous fluid in the shear chamber 110 is returned to the reservoir 150 within a short period of time after the inlet hole 152 has been closed. Though the rotor 111 continues to rotate after the viscous fluid has been discharged from the shear chamber 110, the torque required to drive the rotor 111 becomes nearly zero because there is substantially no viscous fluid left in the shear chamber 110. When the engine is re-started under the condition where there is substantially no viscous fluid left in the shear chamber 110, the torque required to rotate the heat generator is very small. Therefore, the engine can be re-started without bearing a heavy load to start the heat generator.

However, there is a situation where the engine is stopped at a time the heat generator is being operated with the viscous fluid filled in the shear chamber 110 or at a time shortly after the operation of the heat generator discontinued. In this case, the viscous fluid is still left in the shear chamber 110 after the engine stopped. When the engine is re-started under this situation, a large starting torque is necessary because the rotor 111 has to be rotated against the high viscosity of the viscous fluid. To cope with this situation, a space 170 a volume of which is variable is disposed at a bottom portion of the front housing 101. When the temperature of the heat generator becomes low, the volume of the space 170 is increased by the operation of the actuator 175 having the cylinder 176 containing therm-wax therein. The viscous fluid in the shear chamber 110 drips down by its own weight to the space 170 through the dripping passage 171. Because the engine is re-started, in most cases, after the heat generator has been cooled down and substantially no viscous fluid is left in the shear chamber 110, the excessive starting torque is not required. When the heat generator is heated up again, the volume of the space 170 is decreased by the operation of the actuator 175, thereby pushing up the viscous fluid in the space 170 into the shear chamber 110.

The amount of the viscous liquid contained in the shear chamber 110 in this embodiment is about 2 cubic centimeter (cc), and accordingly the volume of the space 170 is also about 2 cc. The capacity of the reservoir 150 is about 28 cc in this embodiment, and the viscous liquid filled in the heat generator 100 is about 20 cc. Considering deterioration of the viscous fluid, it is preferable to use as much viscous fluid as possible.

Incidentally, the electromagnetic valve 160 is de-energized and the inlet hole 152 is closed whenever the engine is not operated. The viscous fluid in the shear chamber 110 drips down into the space 170 the volume of which is increased after the temperature drops, leaving substantially no viscous fluid in the shear chamber 110. Therefore, the rotor 111 of the heat generator 100 can be started again under a substantially no load.

Figure 4:
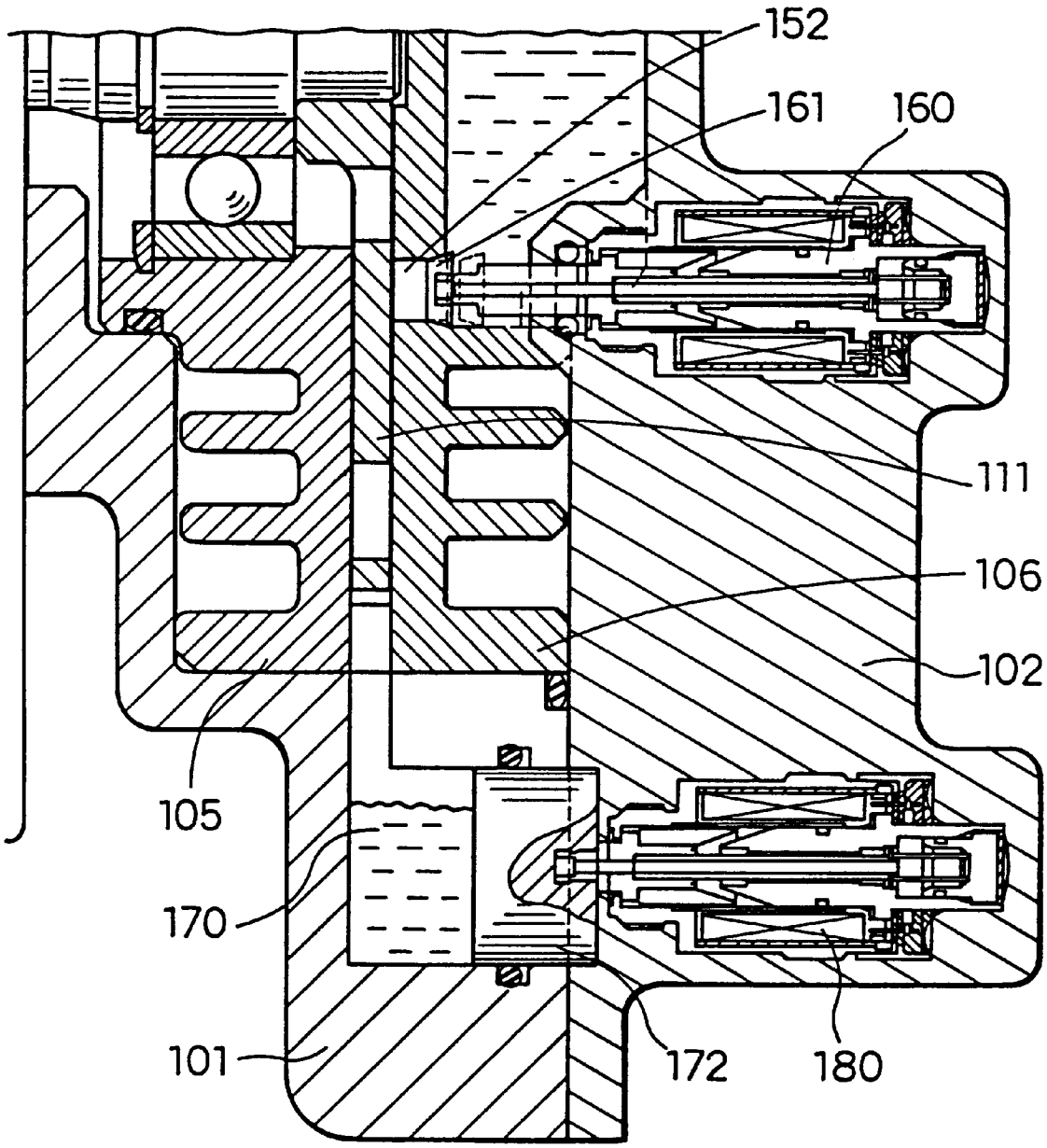
FIG. 4 is a partial cross-sectional view showing a viscous fluid heat generator as a second embodiment according to the present invention.

A second embodiment according to the present invention is shown in FIG. 4 in which the actuator 175 for controlling the volume of space 170 is replaced with an electromagnetic actuator 180. FIG. 4 shows a situation where the space 170 is enlarged by the electromagnetic actuator 180 and the viscous fluid is drained in the space 170. It is possible in the second embodiment to enlarge the space 170 quickly after the engine is stopped even when the temperature of the heat generator is still high. This means that the viscous fluid in the shear chamber 110 can be drained quickly, and the engine can be re-started without bearing the high starting torque of the heat generator 100 even when the engine is started again shortly after a previous stoppage.

Figure 5:
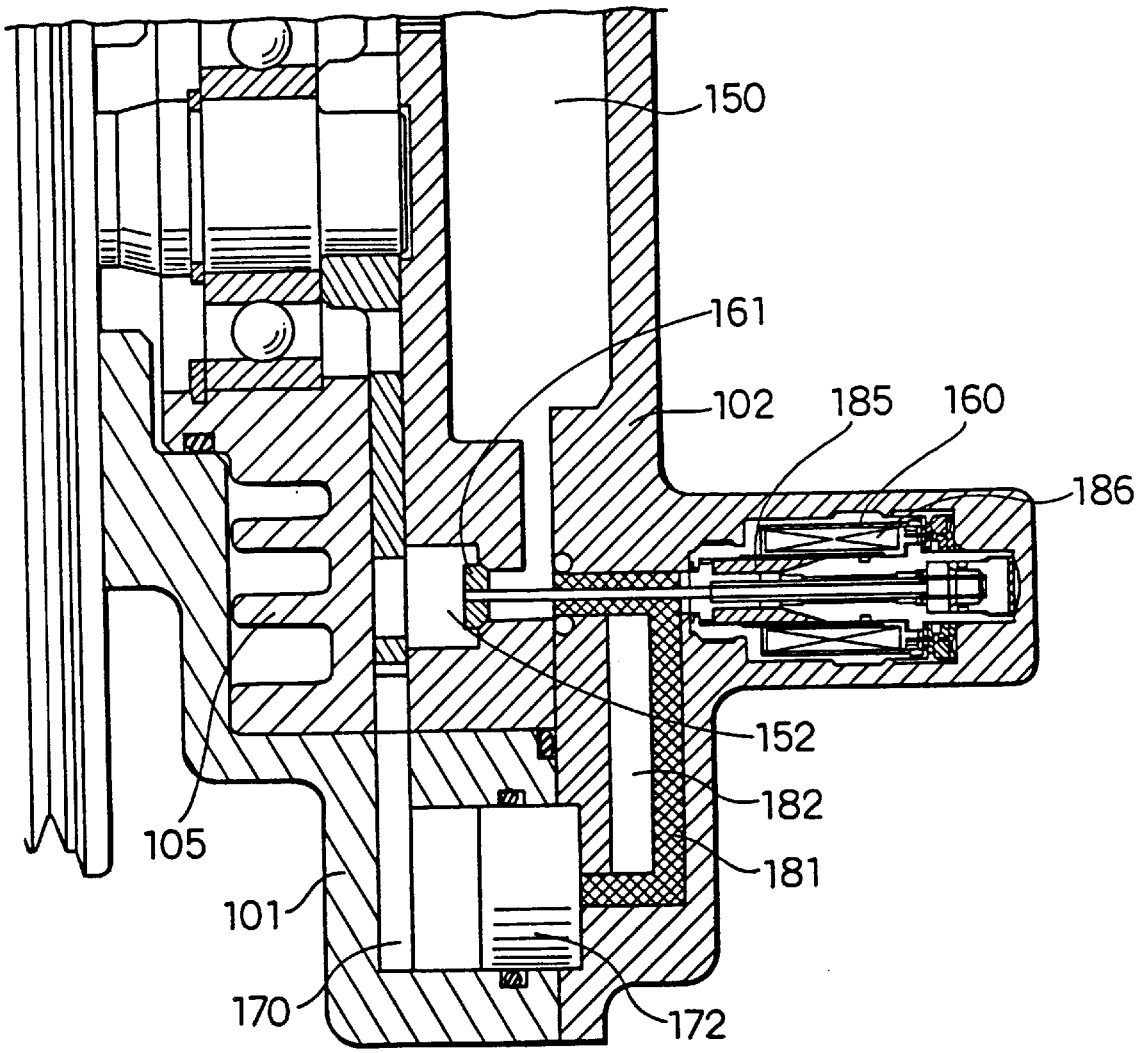
FIG. 5 is a partial cross-sectional view showing a viscous fluid heat generator as a third embodiment according to the present invention.

A third embodiment according to the present invention is shown in FIG. 5 in which the electromagnetic valve 160 drives both of the valve 161 and the piston 172. When the rotor 111 is not rotated, the inlet hole 152 is closed by the valve 161 and the space 170 is enlarged by the piston 172 at the same time. When the rotor 111 stops, a plunger 185 of the electromagnetic valve 160 moves rightward, thereby closing the inlet hole 152 by the valve 161 and at the same time enlarging the space 170 by sliding the piston rightward with a rod 181 connected to the piston 172. To allow the movement of the rod 181, a space 182 is provided in the rear housing 102. The electromagnetic valve 160 may be designed in two ways to perform the same functions. It may be de-energized or energized when the rotor 111 stops.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A viscous fluid heat generator comprising:

a housing;

a shaft rotatably supported in the housing;

a rotor fixedly mounted on the shaft;

a rotor case, disposed in the housing, containing the rotor therein to form a shear chamber having narrow spaces between both surfaces of the rotor and the rotor case;

viscous fluid, contained in the shear chamber, in which heat is generated when the rotor shears the viscous fluid;

a coolant passage, formed in a space between the rotor case and the housing, through which coolant for receiving heat generated in the viscous fluid flows;

a space, disposed underneath the shear chamber, for receiving the viscous fluid drained from the shear chamber;

means for changing a volume of the receiving space;

a reservoir, disposed in the housing separately from the coolant passage, for reserving the viscous fluid therein;

a connecting passage connecting the shear chamber and the reservoir; and means for closing or opening the connecting passage.

2. A viscous fluid heat generator according to claim 1, wherein the volume changing means is a piston disposed slidably in the receiving space, the piston changing the volume of the receiving space according to the temperature of the heat generator so that the volume is increased as the temperature becomes low and decreased as the temperature becomes high.

3. A viscous fluid heat generator according to claim 2, wherein the piston is driven by thermo-wax which changes its volume according to the temperature.

4. A viscous fluid heat generator according to claim 1, wherein the volume changing means is a piston disposed slidably in the receiving space, the piston changing the volume of the receiving space according to the operation of the heat generator so that the volume is increased when the rotor is not rotating and decreased when the rotor is rotating.

5. A viscous fluid heat generator according to claim 4, wherein the piston is driven by an electromagnetic actuator energization of which is responsive to rotation of the rotor.

6. A viscous fluid heat generator according to claim 1, wherein grooves are formed on a surface of the rotor, the grooves extending to a radial direction of the rotor with a slant angle slanted backward with respect to a rotational direction of the rotor, and the viscous fluid in the shear chamber is pushed out toward an outer periphery of the rotor along the grooves as the rotor rotates.

7. A viscous fluid heat generator according to claim 1, wherein a return passage for returning the viscous fluid in the shear chamber to the reservoir is formed on a surface of the rotor case facing the shear chamber, so that the viscous fluid in the shear chamber flows through the return passage from an outer periphery of the shear chamber toward a center thereof.

8. A viscous fluid heat generator according to claim 1, wherein: the connecting passage includes an outlet hole for returning the viscous fluid in the shear chamber to the reservoir and an inlet hole for introducing the viscous fluid into the shear chamber from the reservoir; and the means for opening or closing the connecting passage is an electromagnetic valve which opens the inlet hole when the rotor is rotating and closes the inlet hole when the rotor is not rotating.

* * * * *

UNITED STATES PATENT AND TRADEMARK OFFICE

CERTIFICATE OF CORRECTION

PATENT NO. : 5,896,832
DATED : April 27, 1999
INVENTOR(S) : Shinji Aoki, et. al.

It is certified that error appears in the above-identified patent and that said Letters Patent is hereby corrected as shown below:

Title page, item [56]

Delete all references cited under the heading "OTHER PUBLICATIONS".

Column 1, line 6, delete "Applications" and substitute --Application--.

Column 4, line 10, delete "are" and substitute --is--.

Column 4, line 30, delete "generation" and substitute --generating--.

Column 5, line 19, after "generator", insert --is--.

Column 5, line 21, after "engine" insert --is--.

Signed and Sealed this

Twenty-eighth Day of December, 1999

*Attest:*

Q. TODD DICKINSON

*Attesting Officer*

*Acting Commissioner of Patents and Trademarks*